United States Patent [19]

Gidick

[11] 4,053,068

[45] Oct. 11, 1977

[54] APPARATUS FOR TRANSFERRING HOT COKE INTO A COKE QUENCHING CAR

[75] Inventor: Ward Francis Gidick, West Newton, Pa.

[73] Assignee: Koppers Company, Inc., Pittsburgh, Pa.

[21] Appl. No.: 718,595

[22] Filed: Aug. 30, 1976

[51] Int. Cl.[2] ..... C10B 39/14

[52] U.S. Cl. ..... 214/18 R; 193/3; 193/17; 202/262; 214/41 R

[58] Field of Search ..... 214/18 R, 23, 35 R, 214/41 R; 202/262, 263; 193/3, 17–19, 27, 32

[56] References Cited

U.S. PATENT DOCUMENTS

| | | | |
|---|---|---|---|
| 734,592 | 7/1903 | McClellon | 214/18 R X |
| 3,984,289 | 10/1976 | Sustarsic et al. | 202/262 |

*Primary Examiner*—Robert G. Sheridan

*Attorney, Agent, or Firm*—R. Lawrence Sahr; Oscar B. Brumback

[57] ABSTRACT

Associated with a coke quenching car, preferably a one-spot car, is a coke guide that carries a distributor trough. The distributor trough is pivotably mounted so that when the coke guide is racked out to transfer coke into the quenching car, the distributor is positioned to transfer the coke further out into the car and to better distribute the coke in the car.

9 Claims, 4 Drawing Figures

APPARATUS FOR TRANSFERRING HOT COKE INTO A COKE QUENCHING CAR

BACKGROUND OF THE INVENTION

The invention pertains to coke oven batteries generally and, more particularly, to an improvement in apparatus for transferring hot coke pushed from a coke oven chamber, with means for more uniformly distributing coke, into a one-spot, coke quenching car.

Heretofore, hot coke that was pushed from a coke oven chamber passed through a coke guide and discharged into a coke quenching car that was moved by a locomotive as the coke gravitated into it. The coke was, in this way, more or less uniformly distributed over the bottom of the car.

In such installations, there was and is at the present time, a problem in coordinating the rate of pushing of the coke from the oven chamber with the rate of travel of the quenching car as it catches the coke.

Recently, there has been proposed a number of new designs of coke quenching cars that do not move as coke gravitates into the car, and these new cars are termed one-spot, coke quenching cars.

However, because it is important to minimize the physical dimensions of the one-spot, coke quenching car, it has been found that the proposed new types of one-spot coke quenching cars have not enough capacity to hold all of the coke that is pushed from the taller coke oven chambers being built presently.

Accordingly, it has become necessary to find some novel and unobvious way to distribute more hot coke in currently proposed, one-spot, coke quenching cars. The present invention uniquely accomplishes this result, and the capacity of one-spot, coke quenching cars presently under consideration can carry as much as 20 percent more hot coke by using the present invention in combination with a conventional coke guide.

SUMMARY OF THE INVENTION

Apparatus for transferring hot coke pushed from a coke oven chamber includes a conventional coke guide and a pivotable channel-shaped distributor trough that coacts with the coke guide to distribute the hot coke further out into a coke quenching car. Also, when the distributor trough pivots upwardly after pushing is completed, a plow on the trough further levels the coke in the quenching car.

For a further understanding of the invention and for features and advantages thereof, reference may be made to the following description and the drawing which illustrates a preferred embodiment of equipment in accordance with the invention.

DETAILED DESCRIPTION

Figure 1:
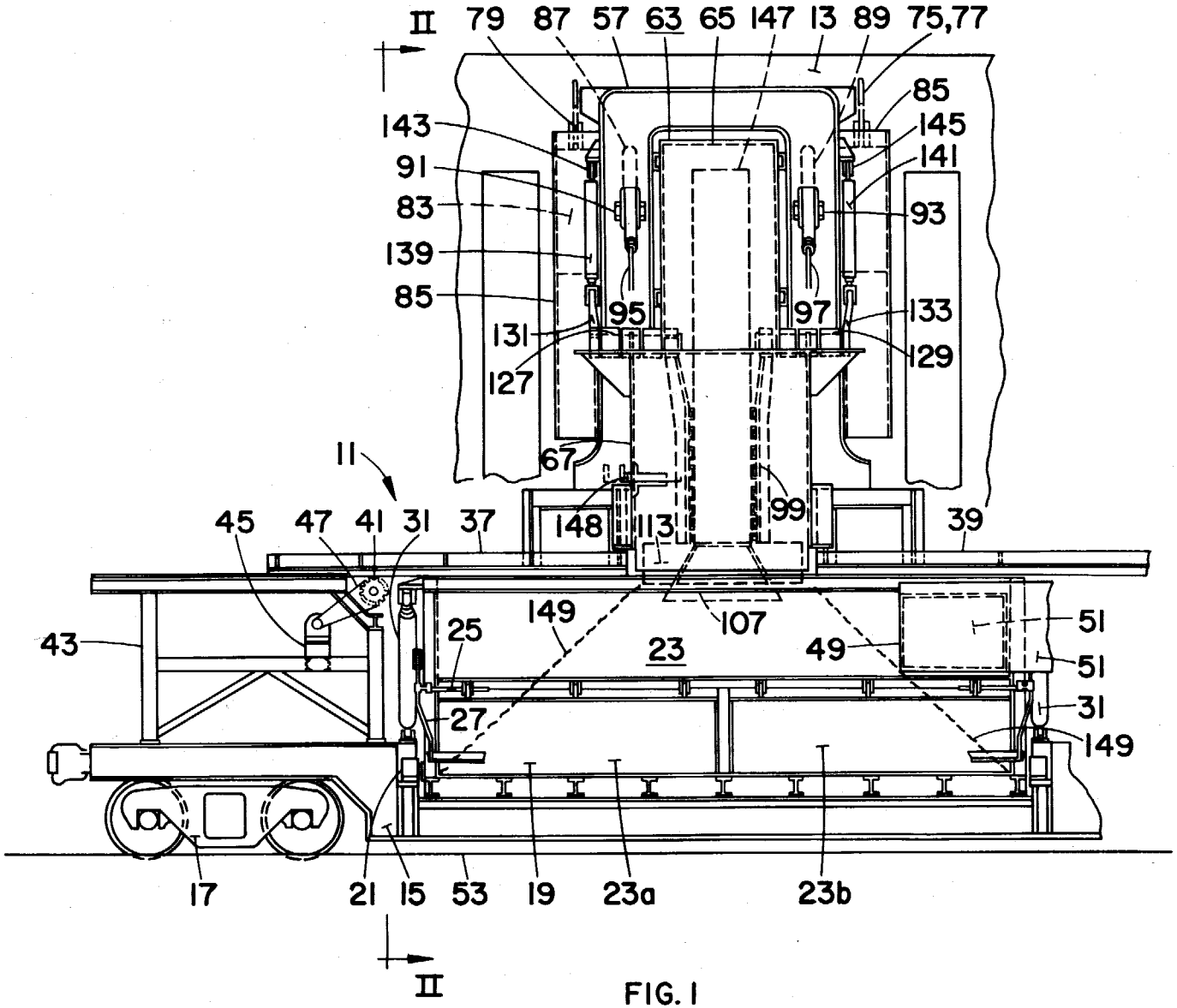
FIG. 1 is an elevational side view of part of the coke side of a coke oven battery showing an embodiment of the invention in association with a coke guide, hood and one-spot coke quenching car.
Figure 2:
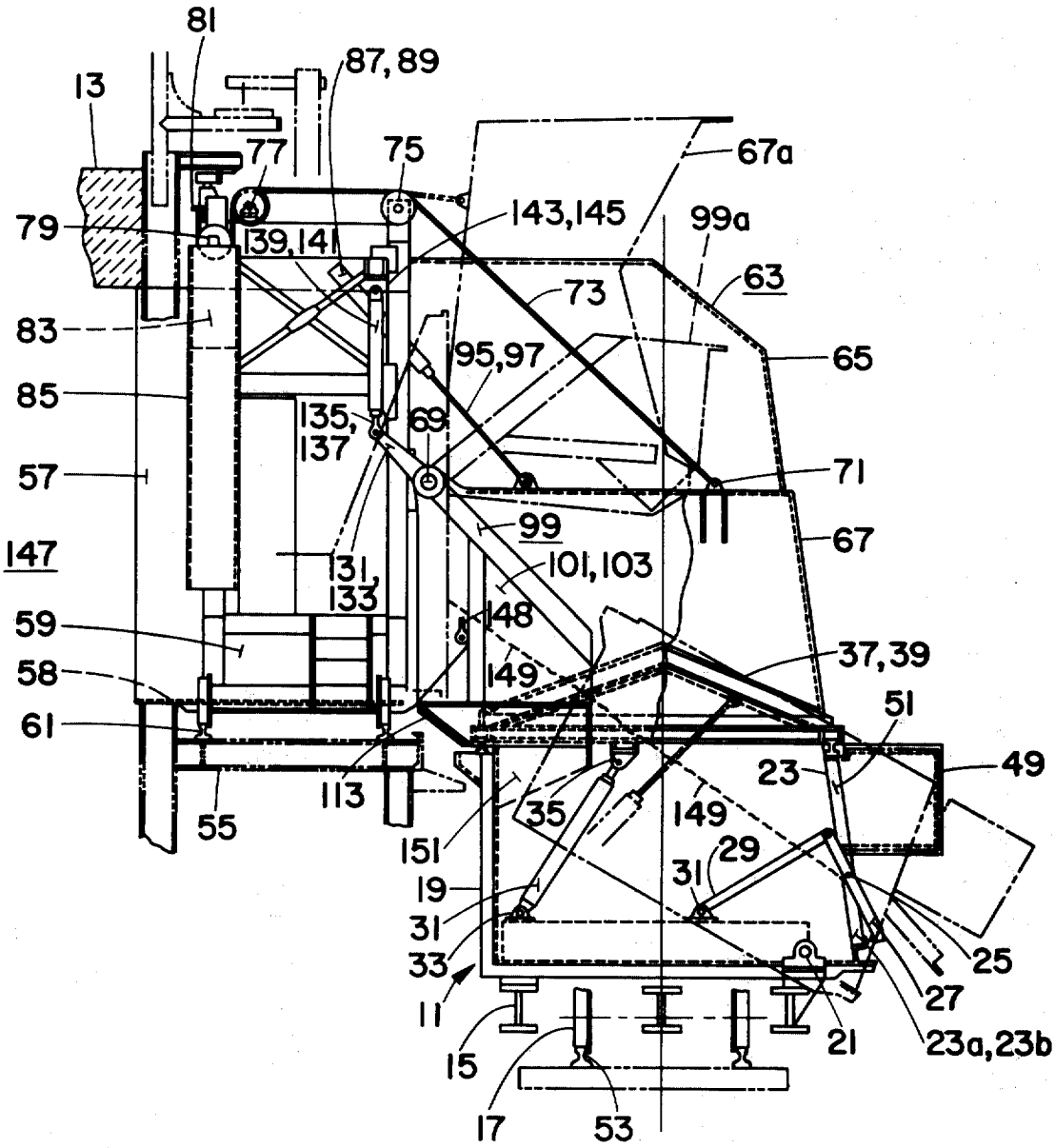
FIG. 2 is a side view, along line II—II, of FIG. 1.

Referring to FIG. 1, a one-spot, coke quenching car 11 is shown in position opposite a chamber of a coke oven battery 13 from which hot coke is to be pushed. The one-spot, coke quenching car 11 comprises a frame 15 carried on conventional trucks 17 at opposite ends of the frame 15, and a coke receiving hopper or receptacle 19 that is pivotally mounted, as at 21, to the frame 15. The hopper 19 has a sloping longitudinal side 23 in which there are two pivoted elongate coke discharge doors 23*a*, 23*b*. Each such pivoted door swings about a shaft 25 and is connected at the bottom, as shown in FIG. 2, to one end of an arm or lever 27. The arm or lever 27 is pivoted to the shaft 25 and the other end of the arm or lever 27 is pivotally connected to a link 29 that is pin-connected to a bracket 31 fixed to the frame 15.

Thus, when the hopper 19 pivots about the axis of the pivot pins 21, the link mechanism 29, 27 automatically pivots the coke discharge doors 23*a*, 23*b* and coke in the hopper 19 discharges therefrom.

The hopper 19 is fitted at each end with cylinder-piston assemblies 31 that are secured at one end to a fixed lug 33 on the frame 15 and to another fixed lug 35 on the hopper. Thus, when the cylinder-piston assemblies 31 are actuated, the hopper 19 pivots about the pivots 21 in a direction away from the coke oven battery 13, as shown in phantom outline in FIG. 2.

The hopper 19 is provided with sliding covers 37, 39 that are each cooperative with a pinion gear 41 journaled to structure 43 mounted to the frame 15. The covers 37, 39 are provided with rollers (not shown) that cooperate with the top edge of the hopper 19 and with the top edge of the structure 43. A motor and speed reducer combination 45 is mounted about where shown in FIG. 1, and a chain or belt 47 connects the pinion gear 41 drivingly to the output of the motor and speed reducer combination 45.

Thus, when the motor and speed reducer combination 45 of each cover 37, 39 is actuated, the covers are moved away from the hopper 19, allowing the coke in the hopper to be quenched and also the hopper to be tilted to discharge the quenched coke therefrom.

The hopper 19, and in particular the slanting side 23, has a fume main 49 mounted to it and the fume main 49 communicates with the interior of the hopper 19 by means of an opening 51 in the side 23. As shown in FIG. 1, the fume main 49 cooperates with an end portion of a conduit 51 that is supported in a fixed location on structure like 43 on the right-hand end of the quenching car 11. The conduit 51 carries gases and particulate matter toward and into conventional gas cleaning equipment located on a gas-cleaning car (not shown) that is coupled to and serves as the traction car for moving the quenching car along rails 53.

Associated with the coke oven battery 13 in the usual manner is a bench 55 on which a movable coke guide 57 travels on a carrige 59 engaging rails 61. The coke guide has a flat, level bottom 58 and is fitted at the front end (that is, on the end way from the coke oven chamber, as shown in FIG. 1) with a two-part, quadrant-type fume hood 63; one part 65 of the hood 63 is fixed in position on the coke guide, while the other part 67 is pivotable about an axis through shafts 69 (FIG. 2).

The pivotable portion 67 of the hood 63 is provided with lugs 71 to which are secured on each side flexible wire ropes 73, or the like, that pass over and cooperate with fixed guide sheaves 75, 77, and around sheave 79 to an anchor 81. The sheave 79 is fixed to one end of a counterweight 83 that reciprocates in a vertically oriented cylindrical tube 85.

The pivotable portion 67 of the hood 63 is actuated by a pair of fluid-acting, cylinder-piston assemblies 87, 89, with each assembly being pivotally supported as at 91, 93 by the structure of the fixed portion of the coke guide 57. The piston portion of each assembly has a piston rod 95, 97 that connects to the pivotal part 67 of the hood 63 to move it.

Figure 3:
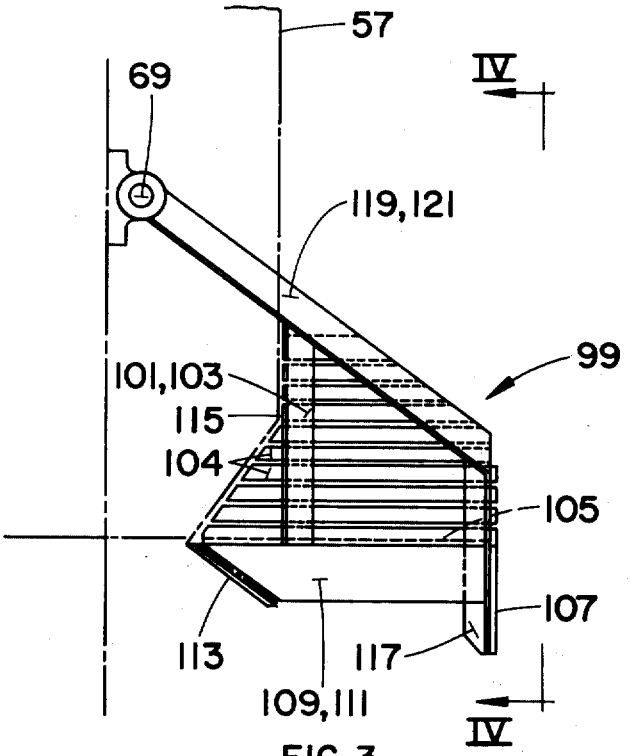
FIG. 3 is an elevational side view of apparatus for transferring not coke in accordance with the present invention.
Figure 4:
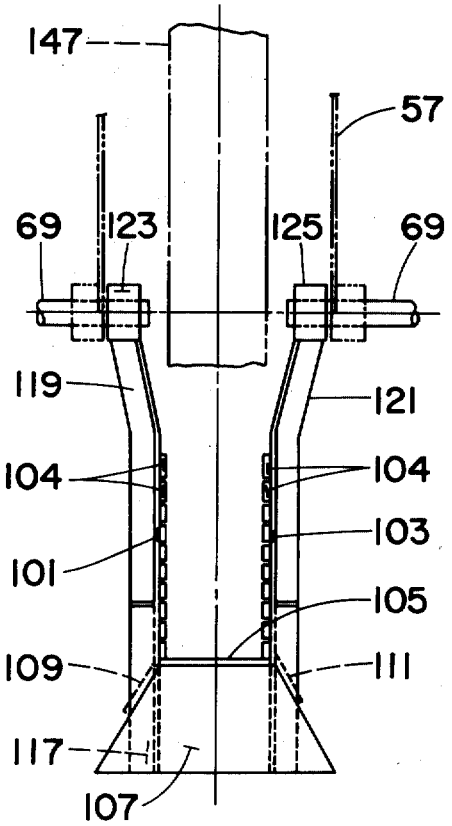
FIG. 4 is a view along line IV—IV of FIG. 3.

Associated with the coke guide 57 is a coke distributor trough 99 (FIGS. 3 and 4) have a channel-shape that is pivotable about the axis of shafts 69. The coke distributor trough 99 includes a pair of spaced-apart vertical sides 101, 103 that are, preferably, comprised of a plurality of spaced apart slats 104, as shown in FIG. 3. The distributor trough 99 has a flat bottom 105, formed as a solid plate without openings. The front edge of the planar bottom plate 105 is fitted with a vertically depending, trapezoidal-shaped plate or plow 107 that connects to two sloping side plates 109, 111, each having a trapezoidal shape, as shown in FIG. 3. Each of the sloping side plates 109, 111 abuts, but is not fastened to, a pivotal tailgate 113 mounted to the planar bottom 105, as shown in FIG. 3.

The slats 104, comprising cumulatively the vertical sides 101, 103, are secured to vertical angle members 115, 117; with the pair of angle members 117 also supporting the vertical plate or plow 107. The vertical angles 115, 117 connect to a pair of sloping angle members 119, 121 which are provided with bearings 123, 125 in which the shafts 69 are journaled.

The shafts 69 extend laterally outward from the bearings 123, 125 to other bearings 127, 129 in which the shafts 69 are journaled. Adjacent bearings 127, 129, the shafts 69 are fixed, as by keys, or in any other suitable manner, to cranks 131, 133. Each crank 131, 133 is pivotally connected to the piston rod portion of the cylinder-piston assemblies 139, 141 which are pivotally connected to lugs 143, 145 secured to the coke guide 57.

As a measure of safety should a malfunction prevent the raising of the distributor trough 99 itself, there is provided, where shown in FIGS. 1 and 2, a slidable bolt 148 that can be actuated manually or by independent suitable mechanical or electro-mechanical means, for example, to engage with the pivotable portion 67 of the hood 63. So that, when the pivotable portion of the hood raises, it will also raise the distributor trough, thereby allowing the covers to close on the car, and the car to move to the quenching station.

Now, in operation, the operator of the gas cleaning car, which serves also as the traction source for the quenching car 11, spots the one-spot quenching car 11 in position at one of the coke oven chambers 147 to receive the hot coke pushed from the chamber 147.

Thereafter, the sliding covers 37, 39 are opened to the catch position, which is a position that admits the movable portion 67 of the hood 63 to fit between the covers 37, 39. The coke guide 57, having previously been spotted at oven chamber 147, is then racked in to make contact with the face of the battery. At the same time a suction is created in the duct 51 to withdraw fumes from the interior of the car 11.

Next, the distributor trough 99, which assumes the stowed position at **99*a* when not in use shown in dotted outline inside the fixed part 65 of the hood 63, is pivoted downward to the operative position shown in solid outline in FIG. 2. At this operative position, the planar bottom 105 of the distributor trough 99 is level with, and serves as a lateral extension of, the flat bottom of the coke guide 58.**

Then, the pivotble part 67 of the hood 63 is lowered from its stowed, inoperative position, shown in dotted outline at 67a, to its operative position, shown in solid outline, where it covers the opening between the movable covers 37. 39.

At this time a cross-battery interlock, forming no part of the present invention, is activated to indicate "ready for push". The pusher machine then commences to push coke from the oven chamber.

The coke first moves through the coke guide in the normal manner, being pushed by a conventional pusher ram, and then it moves through the coke distributor trough, which acts as an extension of the coke guide, since the bottom of the coke guide and the trough are at the same level substantially. Because of the further extension of the coke guide, in the form of the channel-shaped coke distributor trough, the coke, gravitating into the quenching car, builds up rapidly adjacent the outer, slanting wall of the car. When the pushing ceases, the line indicating the top of the coke appears about as shown at 149 in FIGS. 1 and 2. It is to be noted that coke also lies in the coke distributor trough, and it is to be noted also, when the coke gravitates into the car, a void 151 is created underneath and behind the distributor trough 99.

Now then, the operator causes the guide extension or distributor trough to pivot upwardly; the pusher ram head remaining in position of full extension to prevent coke in the guide extension from falling back into the coke guide. While pivoting upward, the plate 107, acting as a plow, pushes the coke in front of it, further outwardly in the car, toward the slanting wall 23. At the same time, the coke resting on the bottom of the distributor trough gravitates into and fills, or partly fills, the void behind and beneath the distributor trough.

Thus, the plow portionacts as a leveler of coke in the car in the path of the pivoting distributor trough, and the filling of the void space under and behind the trough tends to level the coke in the car.

After the guide extension or distributor trough has pivoted upwardly and the coke therein has been discharged therefrom, the coke guide is retracted from the face of the oven chamber and the pusher ram is retracted also.

Thereafter, the operator of the door machine causes the pivotable portion of the hood to raise, while, at the same time, the operator of the gas cleaning car causes the movable covers to close over the hot coke in the car.

All is then ready to allow the coke quenching car to move to a quenching station; the coke guide to move to another oven to be pushed; and the door machine to replace the door on the oven just pushed.

From the foregoing description of one embodiment of the invention, those skilled in the art should recognize many important features and advantages of it, among which the following are particularly significant:

That use of the distributor trough of the invention results in a large percentage increase, amounting to over twenty percent in a typical instance, in the amount of coke loaded into a one-spot quenching car of a given size;

That the action of the distributor trough of the invention results in a partial leveling of the top of the pile of coke in the quenching car; and That, due to the partial leveling of coke in the quenching car, quenching of the coke is more efficient and is completed more quickly.

Although the invention has been described herein with a certain degree of particularly it is understood that the present disclosure has been made only as an example and that the scope of the invention is defined by what is hereinafter claimed.

What is claimed is:

1. Apparatus for transferring coke pushed from a coke oven chamber into a receptacle alongside said chamber, wherein the improvement comprises:

a. guide extension means which linearly directs said coke into the center of said receptacle as said coke is pushed through said guide extension means;

b. pivotal means by which said guide extension means is pivoted vertically upwards and downwards in relation to said coke oven chamber;

c. plow means, fixed to said guide extension means, which spreads said coke within said receptacle when said guide extension means is pivoted vertically upwards; and d. gravitation means cooperating with the vertical pivotation of said guide extension means, which allows residual coke remaining in said guide extension means to be deposited into said receptacle as said guide extension means is pivoted vertically upwards.

2. The invention described in claim 1 wherein:

a. said apparatus is a coke guide;

b. said extension means is a channel-shaped distributor trough having spaced apart vertical sides and a planar bottom that is coextensive with the bottom of said coke guide;

c. said pivotal means is a pivotal mounting of the top most points of said vertical sides to said coke guide and means for raising and lowering said distributor trough pivotally about said pivotal mounting;

d. said plow means is a plate fixed to and depending from the front edge of said planar bottom of said distributor trough, positioned perpendicular to the plane of pivotation of said distributor trough;

e. said gravitation means comprises the inclined plane of said planar bottom as said distributor trough is pivotally raised.

3. The invention described in claim 2 wherein said vertical sides of said distributor trough comprise spaced-apart slats positioned parallel to said planar bottom.

4. Apparatus for transferring coke pushed from a chamber of a coke oven battery into a receptacle comprising:

a. guide means movable alongside said battery and positionable at a chamber to be pushed, said guide means being adapted for transferring said coke from said chamber toward said receptacle;

b. a first hood portion fixed to said guide means, covering a portion of said guide means and extending over said receptacle;

c. a second hood portion pivotally mounted to said guide means and cooperative with said receptacle to cover an access opening in said receptacle through which said coke gravitates;

d. means for vertically pivoting said second hood portion;

e. guide extension means pivotally mounted to said guide means and disposed beneath said first hood portion which directs said coke into the center of said receptacle through said access opening as said coke is pushed through said guide means and said guide extension means;

f. means for vertically pivoting said guide extension means;

g. plow means, fixed to said guide extension means, which spreads said coke within said receptacle when said guide extension means is pivoted vertically upwards; and h. gravitation means, cooperating with the vertical pivotation of said guide extension means, which allows residual coke remaining in said guide extension means to be deposited into said receptacle as said guide extension means is pivoted vertically upwards.

5. The invention described in claim 4 wherein:

a. said guide means is a coke guide;

b. said extension means is a channel-shaped distributor trough having spaced-apart vertical sides and a planar bottom that is coextensive with the bottom of said coke guide;

c. said plow means is a plate fixed to and depending from the front edge of said planar bottom of said distributor trough, positioned perpendicular to the plane of pivotation of said distributor trough; and d. said gravitation means comprises the inclined plane of said planar bottom as said distributor trough is pivotally raised.

6. The invention described in claim 5 wherein said vertical sides of said distributor trough comprise spaced-apart slats positioned parallel to said planar bottom.

7. The invention of claim 4 wherein said receptacle is a coke quenching car that is movable along the coke side of said battery and that has movable means for covering hot coke in said car.

8. Apparatus for transferring coke pushed from a chamber of a coke oven battery into a coke quenching car that is movable along the coke side of said battery and that has movable means for covering hot coke in said car providing an access opening into said coke quenching car comprising:

a. a coke guide movable alongside said battery between said battery and said coke quenching car and positionable at a chamber to be pushed;

b. a first hood portion fixed to said coke guide, covering a portion of said coke guide and extending over said coke quenching car;

c. a second hood portion pivotally mounted to said coke guide and surrounding said first hood portion and cooperative with said coke quenching car to abut said movable means for covering hot coke in said coke quenching car to exclude from the ambient atmosphere gases emitted from said hot coke;

d. means for vertically pivoting said second hood portion;

e. a channel-shaped distributor trough having spaced-apart vertical walls, comprised of spaced-apart slats, and a planar bottom parallel to said slats and that is coextensive with the bottom of said coke guide; said trough being vertically pivotally mounted to the front of said coke guide and disposed beneath said first hood portion, said trough which directs said coke into the center of said coke quenching car through said access opening as said coke is pushed through said coke guide and said distributor trough;

f. means for verticaly pivoting said distributor trough and simultaneously inclining said planar floor of said distributor trough; and g. a plow plate fixed to and depending from the front edge of said planar bottom of said distributor trough, positioned perpendicular to the plane of pivotation of said distributor trough, which spread said coke within said coke quenching car when said distributor trough is pivoted vertically upwards.

9. The invention of claim 8 wherein said means for vertically pivoting said second hood and said means for vertically pivoting said distributor trough coact simulatneously.

* * * * *